US006951165B2

(12) United States Patent
Kuhn et al.

(10) Patent No.: US 6,951,165 B2
(45) Date of Patent: Oct. 4, 2005

(54) FUEL PUMP FOR AN INTERNAL COMBUSTION ENGINE

(75) Inventors: Uwe Kuhn, Riederich (DE); Markus Nieslony, Salach (DE); Rolf Pojar, Erdmannhausen (DE)

(73) Assignee: Robert Bosch GmbH, Stuttgart (DE)

( * ) Notice: Subject to any disclaimer, the term of this patent is extended or adjusted under 35 U.S.C. 154(b) by 196 days.

(21) Appl. No.: 10/432,744

(22) PCT Filed: Nov. 14, 2002

(86) PCT No.: PCT/DE02/04206

§ 371 (c)(1),
(2), (4) Date: May 27, 2003

(87) PCT Pub. No.: WO03/058064

PCT Pub. Date: Jul. 17, 2003

(65) Prior Publication Data

US 2004/0096337 A1 May 20, 2004

(30) Foreign Application Priority Data

Jan. 11, 2002 (DE) ..... 102 00 792

(51) Int. Cl.[7] ..... F16J 1/10
(52) U.S. Cl. ..... 92/129; 92/72
(58) Field of Search ..... 92/72, 129, 255, 92/256

(56) References Cited

U.S. PATENT DOCUMENTS 2,372,694 A * 4/1945 Tabb ..... 92/129
3,857,642 A * 12/1974 Miller ..... 92/129
5,382,140 A 1/1995 Arnold et al.
5,980,214 A * 11/1999 Djordjevic ..... 92/72
6,250,893 B1 6/2001 Streicher
6,347,574 B1 * 2/2002 Guentert et al. ..... 92/72
6,412,474 B1 * 7/2002 Guentert et al. ..... 123/456
6,431,842 B1 * 8/2002 Furuta ..... 92/129

FOREIGN PATENT DOCUMENTS

DE 199 56 092 A 10/2000
DE 100 18 708 A 11/2000
WO 99 45271 A 9/1999

* cited by examiner

*Primary Examiner*—Edward K. Look
*Assistant Examiner*—Michael Leslie
(74) *Attorney, Agent, or Firm*—Michael J. Striker

(57) ABSTRACT

A fuel pump for an internal combustion engine, comprising a housing (14) in which a piston (16) is guided. A working chamber is confined in areas by the piston (16). An eccentric shaft or camshaft acts on the piston (16) on its end furthest from the working chamber. A prestressing element (30) loads the piston (16) against the eccentric shaft or camshaft. In order to reduce the fabrication costs of the fuel pump, the invention provides that a support member (40) that is separate from the piston (16) is provided, which said support member is interconnected with the end region (36) of the piston (16) closest to the eccentric shaft or camshaft, and against which the prestressing element (30) bears.

10 Claims, 5 Drawing Sheets

FUEL PUMP FOR AN INTERNAL COMBUSTION ENGINE

BACKGROUND OF THE INVENTION

The invention relates to a fuel pump for an internal combustion engine, with a housing, with at least one piston, with a working chamber that is confined in areas by the piston, with an eccentric shaft or camshaft that acts on the piston, at least indirectly, on its end furthest from the working chamber, and with a prestressing element that loads the piston, at least indirectly, against the eccentric shaft or camshaft.

A fuel pump of this nature is known from the marketplace, as a radial-piston pump, for example. In the case of said fuel pump, a central eccentric shaft is supported in a housing. A cam ring is mounted on an eccentric section of the eccentric shaft. Flat surfaces are formed around the circumference of the cam ring, against which slippers rest. The slippers are interconnected with a cylindrical piston; the end of said cylindrical piston that is furthest from the eccentric shaft confines a working chamber. The piston is loaded by a compression spring against the slipper or against the flat surface of the cam ring.

Three cylinders are provided in the known fuel pump, each comprising one corresponding piston and one corresponding working chamber. When the eccentric shaft moves, the piston is set to moving to and fro, and the fuel present in the working chamber is compressed and ejected via appropriate valve devices, e.g., into a fuel manifold ("rail") of an internal combustion engine.

In the case of the fuel pump known from the marketplace, the compression spring bears against an end section of the piston that has a markedly greater diameter than the shaft of the piston. The end section and the piston shaft are a single piece and are worked out from a whole unit on a lathe, for example. To guide the compression spring and reduce tension in the transition regions between the piston shaft and the end section, it is necessary to provide grooves and shoulders with different diameters. In combination with the associated great differences in diameter, in particular, this makes costly chip-removal machining necessary, which has a disadvantageous effect on the costs to fabricate the fuel pump.

The object of the present invention, therefore, is to further develop a fuel pump of the type stated initially in such a way that it can be fabricated less expensively.

The object is attained with a fuel pump of the type stated initially by providing a support member that is separate from the piston, which said support member is interconnected with the end region of the piston closest to the eccentric shaft or camshaft, and against which the prestressing element bears.

SUMMARY OF THE INVENTION

In the case of the fuel pump according to the invention, the piston of the fuel pump has a markedly simpler configuration. In the simplest case, it can be composed of a simple straight cylinder that has no changes in diameter. This eliminates the need for costly chip-removal machining of the piston, which greatly reduces the costs of the fuel pump according to the invention.

The support of the prestressing element, usually a compression spring that loads the piston against the eccentric shaft or camshaft, takes place in the case of the fuel pump according to the invention via a separate support member that is securely interconnected with the piston. The connection of the support member with the piston can take place in different ways, including, for example, by means of a press fit, a shrinkage fit, welding, bonding, and other fastening variants described in detail hereinbelow. Although an additional working step is required to secure the support member on the piston, it is more cost-effective than the chip-removal machining of the piston described hereinabove.

Advantageous further developments of the fuel pump according to the invention are stated in the dependent claims.

The invention provides, first of all, that the support member comprises a support ring. A support ring of this type is very easy to fabricate, which is another favorable factor in terms of the cost of the fuel pump.

The invention thereby provides that the support member is two-pieced and comprises a support ring interconnected with the end region of the piston and an intermediate element pushed onto the piston between prestressing element and support ring. This makes it possible to select a material for the support ring that can be secured on the piston in optimal fashion. For the intermediate element, on the other hand, a material can be selected that can be formed in a simple manner in such a way that the prestressing element is retained and guided in optimal fashion. This further development therefore increases the operational reliability of the fuel pump according to the invention as well.

In another further development, the invention provides that one section of the support member abuts a retainer that is accommodated, in areas, in a groove in the end region of the piston closest to the eccentric shaft or camshaft. This method of securing is very simple, and it can be undone by destroying the retainer, for example.

The invention also provides that the fuel pump comprises a guide sleeve capable of moving with the piston, which said guide sleeve cooperates with a guide section secured to the housing. By way of this, the fact that lateral forces must be dissipated into the pump housing during operation is taken into account. Although these lateral forces can also be absorbed in the housing via the guiding of the piston, it is more favorable in terms of sealing if the piston is loaded in the axial direction only. This is made possible by means of the guide sleeve according to the invention, since it dissipates the lateral forces from the eccentric shaft or camshaft directly into the guide section secured in the housing while bypassing the piston. A fuel pump having a configuration of this type therefore functions with high efficiency.

In particular, a fuel pump of this type can be fabricated cost-effectively when the support member is integral with the guide sleeve.

The support member can also comprise a radially inwardly directed annular collar that rests against a radially outwardly directed annular collar of the piston. The support element is therefore pressed by the prestressing element with its annular collar against the corresponding annular collar of the piston. The connection of the support member with the piston created as a result enables the piston to return reliably after a compression stroke without lateral forces being introduced into the piston by the support element. This is particularly advantageous when the support member is integral with the guide sleeve.

Another advantageous embodiment of the fuel pump according to the invention provides that the fuel pump comprises a base part that abuts the end surface of the piston closest to the eccentric shaft or camshaft. A base part of this type also makes it possible to develop the piston out of a material that is optimal for its function as compression plunger. On the other hand, it is possible to design the base part out of a material that can absorb the relative motions produced by the rotation of the camshaft or eccentric shaft relative to the piston without incurring excess wear. Furthermore, appropriate material pairs can be used in order to also reduce the frictional forces between the base part and the eccentric shaft or camshaft, which results in lower lateral forces. This further development therefore has additional advantages in terms of the function of the fuel pump according to the invention.

It is also preferred if the guide sleeve comprises a radially inwardly directed annular collar that extends into an annular space located between support member and base part. By way of this, the guide sleeve is held securely in the axial direction, and, simultaneously, assembly of the fuel pump according to the invention is simple and, therefore, cost-effective.

It is also advantageous if the base part comprises an upwardly extending section that covers the support member axially in areas, and the support member is securely interconnected with the base part via the upwardly extending section. A base part of this type is therefore designed in the shape of a bucket and is automatically centered relative to the support member during assembly by means of the upwardly extending section. The base part can be secured on the support member via a retainer, for example, that is inserted in the lateral surface of the support member, on the one hand and, on the other, in the lateral surface of the upwardly extending section.

An advantageous further development of the fuel pump according to the invention is also unique in that the support member comprises at least one bent-over section that grips around the outside of the base part and provides axial support for said base part. A bent-over section of this type is easy to fabricate and simplifies overall assembly of the fuel pump, since the base part is captively interconnected with the support member.

BRIEF DESCRIPTION OF THE DRAWINGS

Particularly preferred exemplary embodiments of the present invention are described in detail hereinbelow with reference to the attached drawings.

DETAILED DESCRIPTION OF THE PREFERRED EMBODIMENTS

Figure 1:
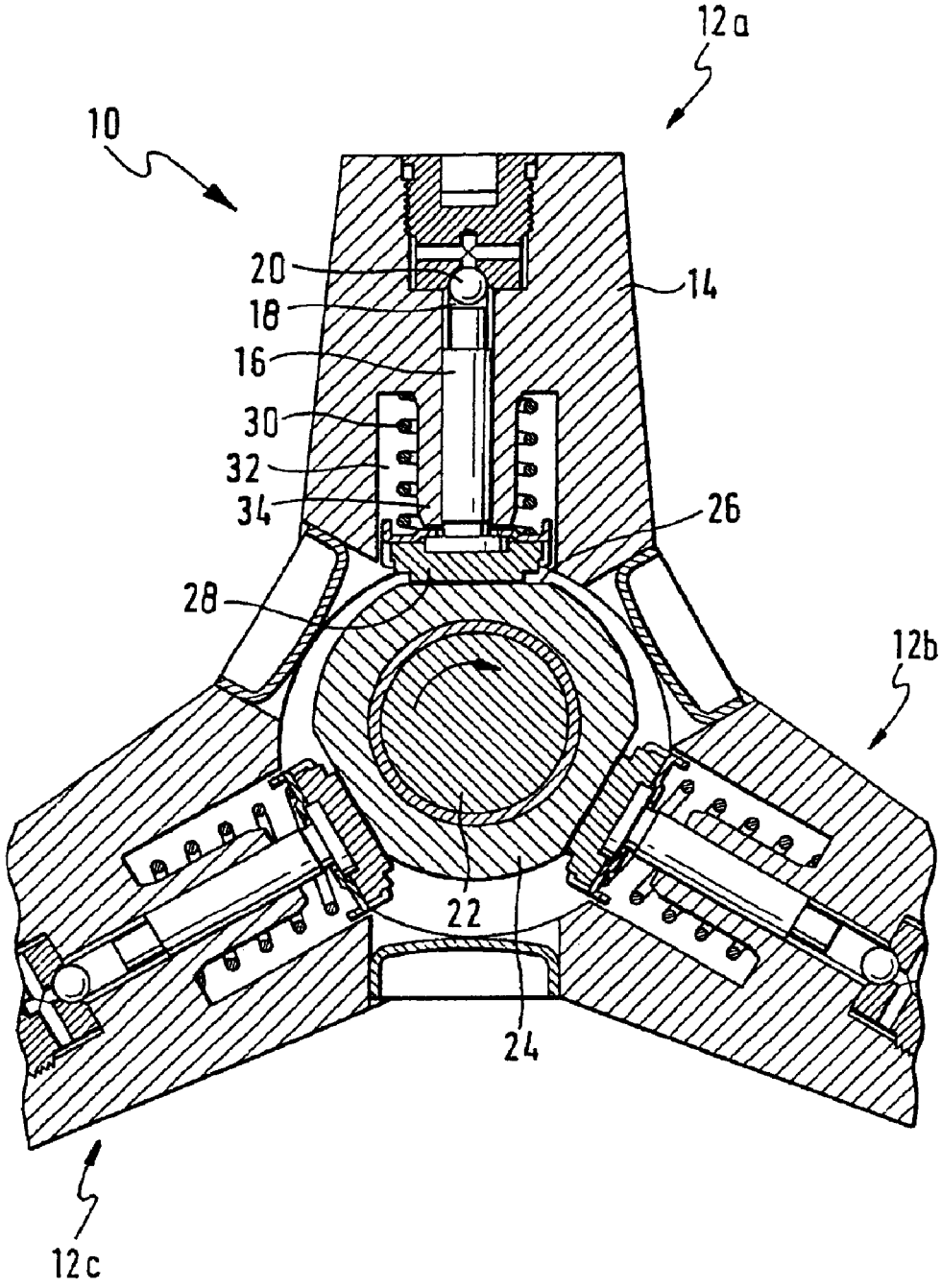
FIG. 1 is a sectional drawing through a region of a first exemplary embodiment of a radial-piston fuel pump.

In FIG. 1, a fuel pump as a whole is labelled with reference numeral 10. Said fuel pump is a radial-piston pump having three cylinders 12*a*, 12*b* and 12*c*. Only the components of cylinder 12*a* will be described in detail hereinbelow. In the drawings, only the components of cylinder 12*a* are labelled with reference numerals. The components of cylinders 12*b* and 12*c* are identical to those of cylinder 12*a*.

The radial-piston pump 10 comprises a housing 14. A piston 16 is accommodated in a bore (not labelled with a reference numeral) in axially displaceable fashion. The piston 16, with its end surface shown at the top in FIG. 1, confines a working chamber 18. An intake valve 20 can connect the working chamber 18 with a not-shown fuel line. A not-shown outlet valve can connect the working chamber 18 with a fuel line and, further, with a high-pressure manifold ("rail").

An eccentric shaft with an eccentric section 22 is supported in the housing 14 of the radial-piston pump 10. A cam ring 24 is mounted on the eccentric section 22, which said cam ring comprises a machined-flat contact area 26 in the region of each of the individual cylinders 12*a*–12*c*. A base part 28 configured as slipper is loaded—indirectly and in a manner to be described in greater detail—by a compression spring 30 against the contact area 26. The compression spring 30 is accommodated in an annular space 32 in the housing 14. Said annular space is confined radially inwardly by a guide section 34 designed in the shape of a tubular section. In turn, the piston 16 is accommodated in gliding and liquid-tight fashion in said guide section. The connection of the piston 16 with the base part 28 and the piston-side support of the compression spring 30 will now be described in detail in conjunction with FIG. 2:

The piston 16 comprises an end region 36 facing the eccentric section 22 and the cam ring 24 and the cam ring 24, which said end region has a larger diameter than the rest of the piston 16. The end region 36 is accommodated in areas in a complementary recess 38 in the base part 28. A support member 40 designed in the shape of a washer abuts a projection 41 formed between the piston shaft 39 and the end region 36 of the piston 16. The support element 40 comprises a radially inwardly extending holding section 42 and an axially extending guide section 44. The support member 40 is centered relative to the longitudinal axis of the piston 16 by these two sections 42 and 44.

Figure 2:
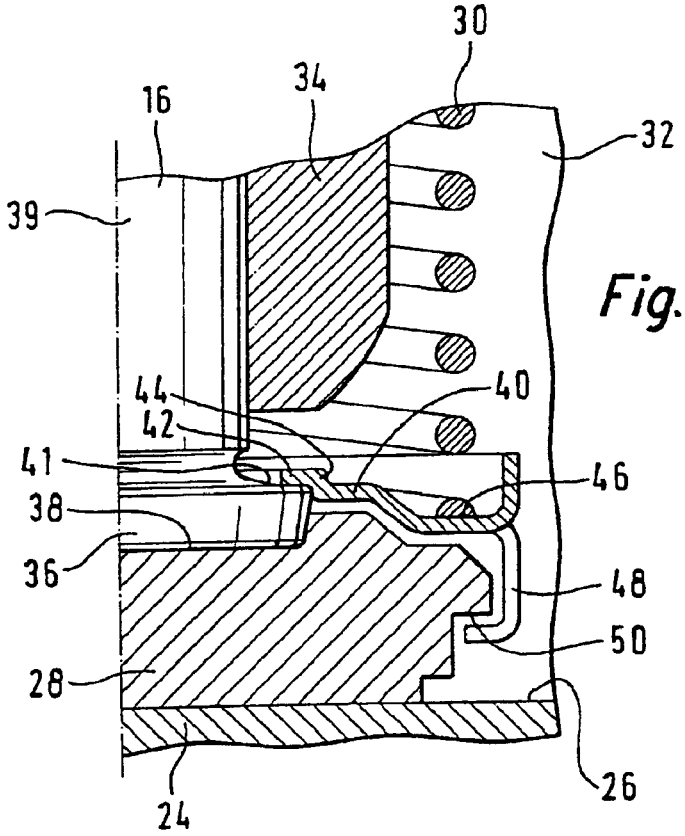
FIG. 2 is a partial sectional drawing through a detail of the fuel pump in FIG. 1.

In its radially outward region, the support member 40 comprises a groove-like recess 46 extending in the circumferential direction that is "open" in the axial direction, in which said recess the lower end—as shown in FIG. 2—of the compression spring 30—is accommodated. On its radially outward edge, the support member 40 comprises a plurality of hook-like bent-over sections 48 distributed around its circumference that grip around—with some play—a projection 50 formed on the outer lateral surface of the base part 28. In this manner, the base part 28 is held axially against the piston 16.

The radial-piston pump 10 functions as follows: When the eccentric shaft with the eccentric section 22 rotates, the center of the cam ring 24 moves along a circular path. As a result of this, the contact areas 26 of the cam ring 24 move in the axial direction of the respective cylinder 12 on the one hand and, on the other, laterally relative to the longitudinal axis of the respective cylinder 12. As a result of the axial movement of the contact areas 26 and the return force of the compression spring 30, the piston 16 is set into an axial to-and-fro motion via the base part 28. As a result of this, fuel is either drawn into the working chamber 18, or the fuel present in the working chamber 18 is compressed and ejected in the direction of the fuel manifold.

Figure 3:
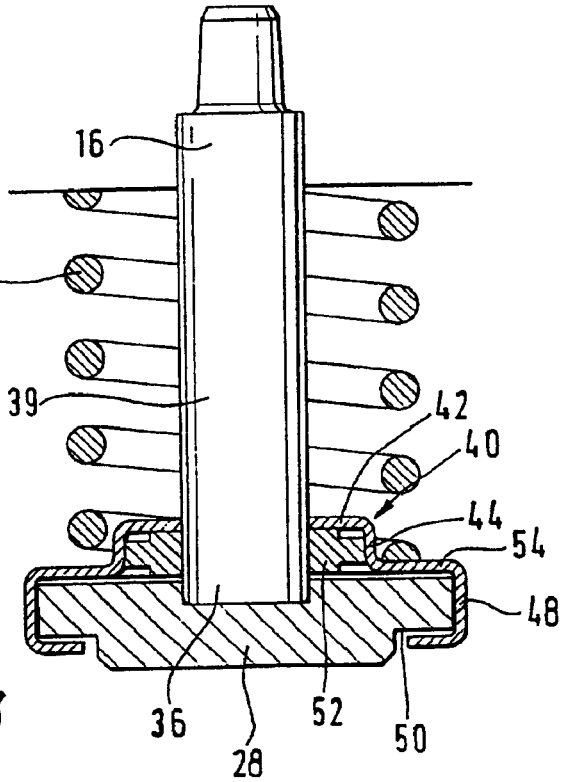
FIG. 3 is a partial sectional drawing through components of a second exemplary embodiment of a fuel pump.

A variation of the region of the piston 16 facing the eccentric section 22 is shown in FIG. 3. The elements and areas having functions equivalent to the embodiment shown in FIGS. 1 and 2 are labelled with the same reference numerals. They are not described in detail again.

In contrast to FIGS. 1 and 2, the diameter of the end region 36 of the piston 16 shown in FIG. 3 is not different from the diameter of the shaft 39 of the piston 16. The piston 16 is therefore even easier to fabricate. Furthermore, the support member 40 is configured as two pieces. It comprises a support ring 52 that is pressed onto the piston 16. In this fashion, the support ring 52 is secured on the piston 16 in an axially non-displaceable fashion. An intermediate element 54 is pushed onto the piston 16 from the top down as viewed in FIG. 3, which said intermediate element is centered relative to the support ring 52 with a holding section 42 and a guide section 44.

In FIGS. 2 and 3, a certain amount of play exists between the support element and the base part 28. In other, not-shown exemplary embodiments, the base part is interconnected with the piston 16 without play.

As a result of the above-described movement of the contact areas 26 laterally relative to the longitudinal axis of the respective cylinder 12, lateral forces are also introduced into the base part 28 by the contact areas 26 due to the friction that is present. In the case of the radial-piston pump 10 described hereinabove (FIGS. 1 and 2), and in the case of the embodiment of the components according to FIG. 3, these lateral forces are introduced into the piston 16 and dissipated by said piston into the guide section 34 of the housing 14. In the exemplary embodiments described hereinbelow according to FIGS. 4–8, possibilities for holding the piston 16 in a manner that is free of transverse forces are presented. In this case as well, components and parts that have functions that are equivalent to those of previously-described components and parts have the same reference numerals and shall not be described in detail again.

Figure 4:
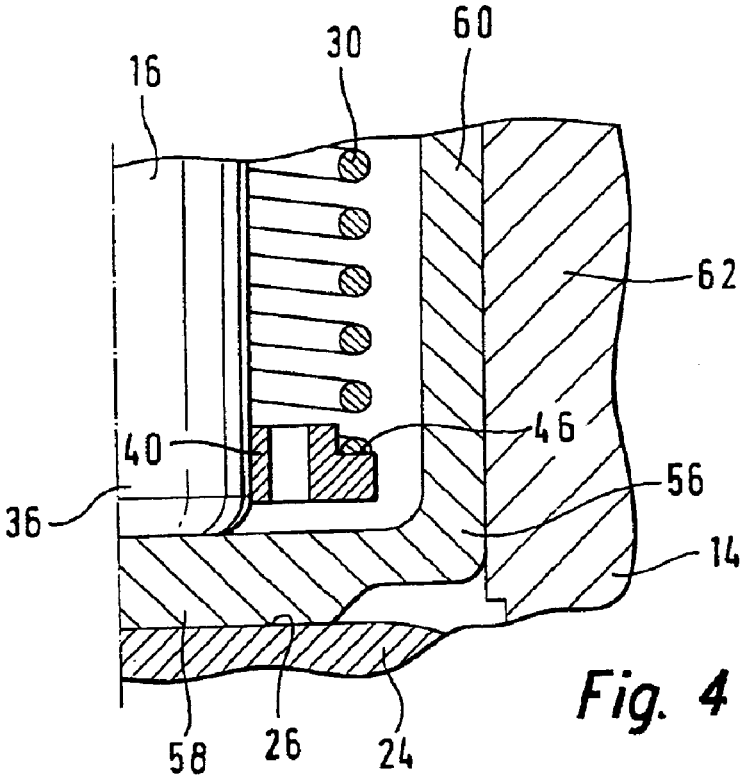
FIG. 4 is a partial sectional drawing through components of a third exemplary embodiment of a fuel pump.
Figure 5:
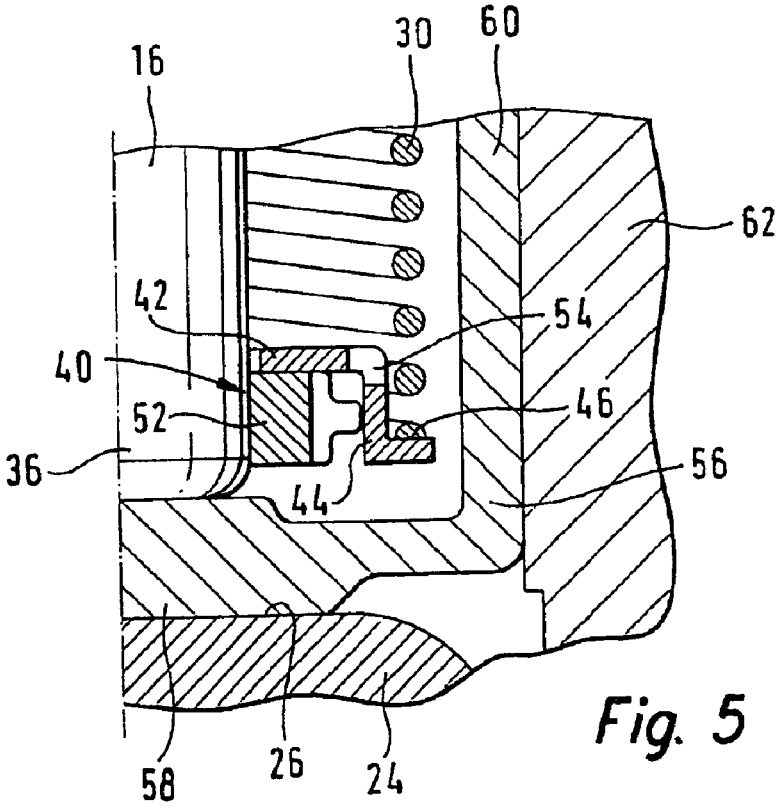
FIG. 5 is a partial sectional drawing through components of a fourth exemplary embodiment of a fuel pump.

In FIGS. 4 and 5, exemplary embodiments having a "bucket guide" are presented. Said bucket guide comprises a guide part 56 configured in the shape of a bucket that rests via the outside of a base 58 against the contact area 26 of the cam ring 24. The end region 36 of the piston 16 rests against the inside of the base 58 of the bucket-shaped guide part 56. A circumferential wall 60 of the bucket-shaped guide part 56 is guided via its outer side into a guide section 62 of the housing 14. The lateral forces introduced into the base 58 of the bucket-shaped guide part 56 by the contact area 26 when the radial-piston pump 10 operates are dissipated directly into the guide section 62 of the housing 14 via the circumferential wall 60. This enables the piston 16 to remain free of transverse forces.

The support member in FIG. 4 is configured as a single-component support ring 40 that is pressed onto the piston 16. There are no changes in diameter on the end region 36 of the piston 16. In the case of the exemplary embodiment according to FIG. 5, the support member 40 is configured with two components once more, namely a support ring 52 that is pressed onto the piston 16, and an intermediate element 54.

Figure 6:
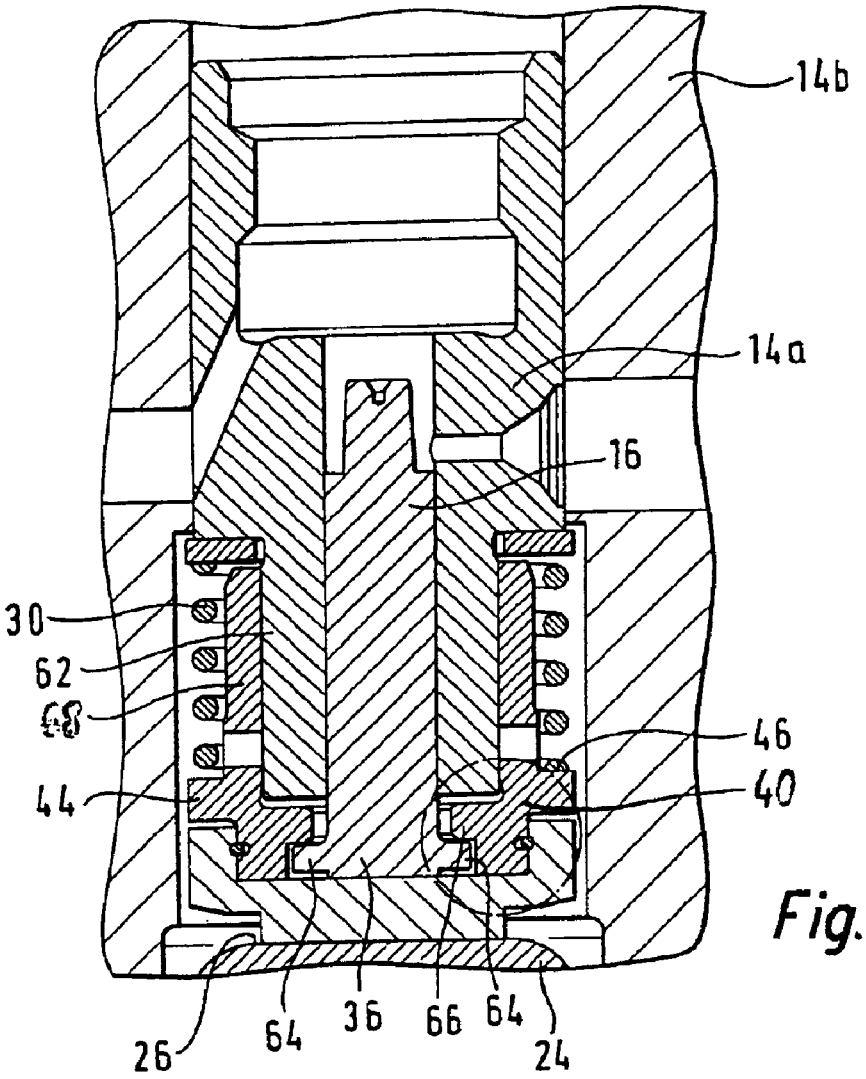
FIG. 6 is a partial sectional drawing through components of a fifth exemplary embodiment of a fuel pump.
Figure 7:
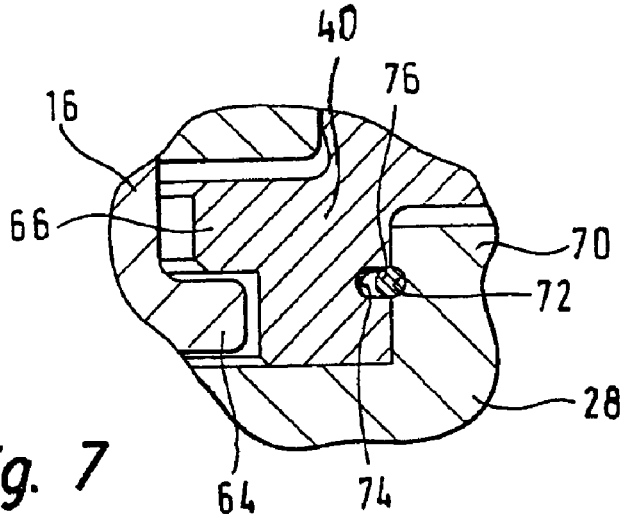
FIG. 7 is an enlarged detail of FIG. 6.

In the case of the exemplary embodiment presented in FIGS. 6 and 7, the end region 36 of the piston 16 once more has a greater diameter than the shaft 39 of the piston 16, thereby forming a radially outwardly directed annular collar 64. This annular collar 64 is guided axially, on the one hand, between a radially inwardly directed annular collar 66 of a guide sleeve 68 and a base part 28 bearing against the end surface of the piston 16.

On its radially outward edge, the base part 28 comprises a circumferential, upwardly extending section 70 that covers the guide sleeve 68 in areas in the axial direction. As shown in FIG. 7, a circumferential groove 72 is provided on the inner side of the upwardly extending section 70 on the one hand and, on the other, a circumferential groove 74 is provided on the outer side of the guide sleeve 68. A retainer 76 is accommodated in groove 72 on one side and in groove 74 on the other side, so that the guide sleeve 68 and the base part 28 are securely interconnected.

The guide sleeve 68 is guided in sliding fashion in the axial direction on a guide section 62 of the housing 14. This permits transverse forces—that are introduced into the base part 28 via the contact area 26 of the cam ring 24—to be introduced into the guide section 62 of the housing 14 via the guide sleeve 68. As shown in FIG. 6, the guide section 62 is part of a bushing 14*a* that is shrink-fit into a housing region 14*b*. The guide sleeve 68 comprises a radially outwardly directed annular collar 44 against which the compression spring 30 bears. In this manner, the piston 16 is loaded indirectly with the return force of the compression spring 30. The guide sleeve 68 therefore simultaneously forms the support element 40.

Figure 8:
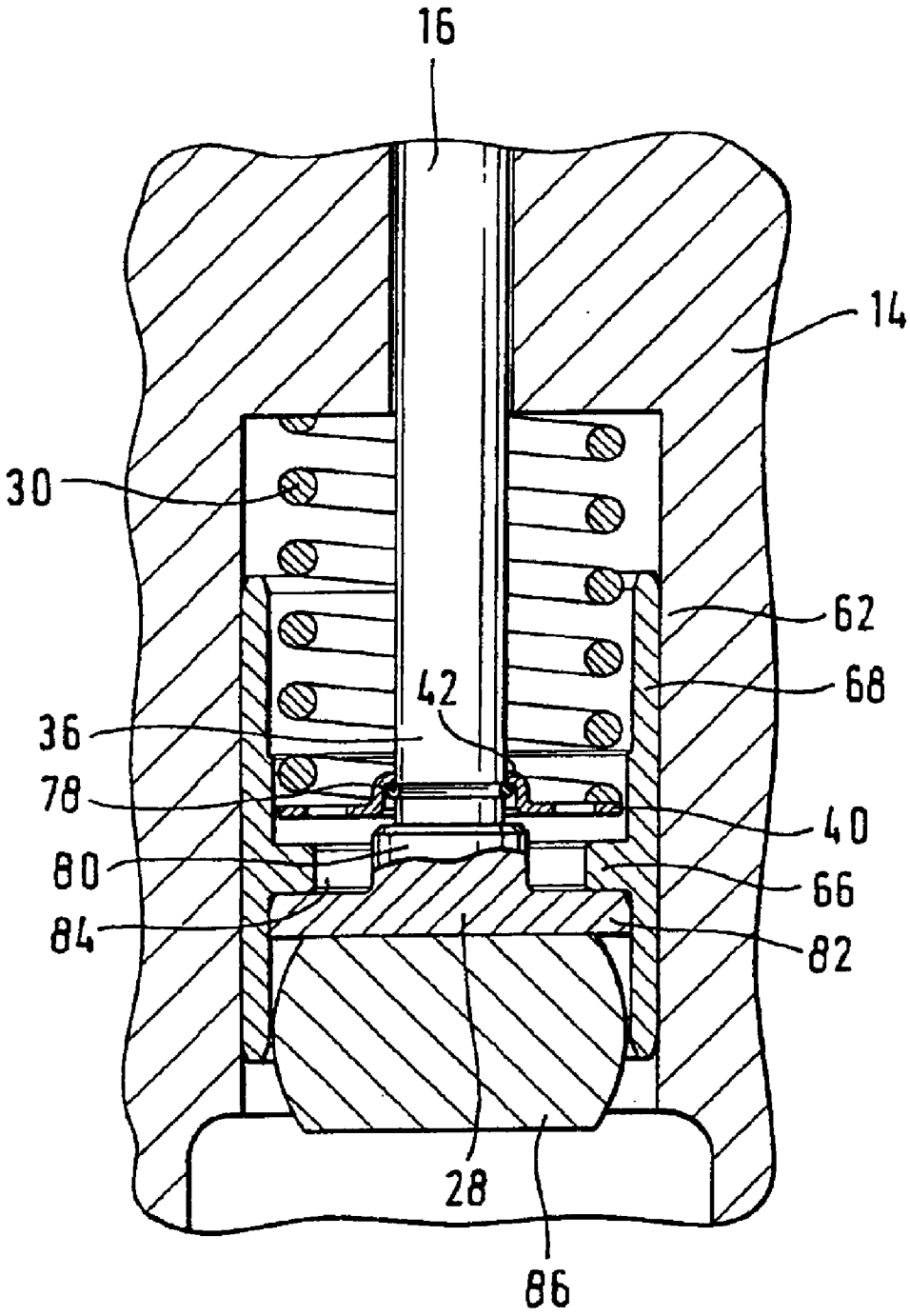
FIG. 8 is a sectional drawing through components of a sixth exemplary embodiment of a fuel pump.

Yet another exemplary embodiment is presented in FIG. 8. In this exemplary embodiment, the end region 36 of the piston 16 once more has the same diameter as the shaft 39 of the piston 16. The support element 40 is configured as support ring, the holding section 42 of which abuts a retainer 78 that lies in a circumferential groove (not labelled with a reference numeral) in the end region 36 of the piston 16. In this case as well, transverse forces are kept away from the piston 16 by the fact that a guide sleeve 68 cooperates with a guide section 62 of the housing 14.

The base part 28 comprises a section 80—shown at the top in FIG. 8—having a smaller diameter, and a section 82—shown at the bottom in FIG. 8—having a larger diameter. The top side of section 80 of the base part 28 bears against the end face—facing said section 80—of the piston 16. An annular space 84 is provided between the section 82 of the base part 28 and the support member 40, in which said annular space a radially inwardly directed annular collar 66 of the guide sleeve 68 extends. Furthermore, the radially outward edge of section 82 of the base part 28 bears against the inner wall of the guide sleeve 68. In this manner, transverse forces are once again kept away from the piston 16. A roller 86 is also provided between the base part 28 and the cam ring 24 not shown in FIG. 8. Said roller minimizes the transverse forces as well.

What is claimed is:

1. A fuel pump (10) for an internal combustion engine, comprising: a housing (14), with at least one piston (16), with a working chamber (18) that is confined in areas by the piston (16), with an eccentric shaft (22) or camshaft that acts on the piston (16) at least indirectly on its end (36) furthest from the working chamber (18), and with a prestressing element (30) that loads the piston (16) at least indirectly against the eccentric shaft (22) or camshaft, wherein a support member (40) that is separate from the piston (16) is provided, which said support member is interconnected with the end region (36) of the piston (16) closest to the eccentric shaft (22) or camshaft, and against which the prestressing element (30) bears, and further comprising a guide sleeve (68) capable of moving with the piston (16), which said guide sleeve cooperates with a guide section (62) secured to the housing, wherein the guide sleeve (68) comprises a radially inwardly directed annular collar (66) that extends into an annular space (84) located between support member (40) and base part (28).

2. The fuel pump (10) according to claim 1, wherein the support member (40) comprises a support ring (52).

3. The fuel pump (10) according to claim 2, wherein the support member (40) is two-pieced and comprises a support ring (52) interconnected with the end region (36) of the piston (16) and an intermediate element (54) pushed onto the piston (16) between prestressing element (30) and support ring (52).

4. The fuel pump (10) according to claim 1, wherein one section (42) of the support member (40) abuts a retainer (78) that is accommodated, in areas, in a groove in the end region (36) of the piston (16) closest to the eccentric shaft (22) or camshaft.

5. The fuel pump (10) according to claim 1, wherein it comprises a guide sleeve (68) capable of moving with the piston (16), which said guide sleeve cooperates with a guide section (62) secured to the housing.

6. The fuel pump (10) according to claim 5, wherein the support member (40) is integral with the guide sleeve (68).

7. The fuel pump (10) according to claim 1, wherein the support member (40) comprises a radially inwardly directed annular collar (66) that rests against a radially outwardly directed annular collar (64) of the piston (16).

8. The fuel pump (10) according to claim 1, wherein said fuel pump comprises a base part (28) that abuts the end surface of the piston (16) closest to the eccentric shaft (22) or camshaft.

9. A fuel pump (10) for an internal combustion engine, comprising: a housing (14), with at least one piston (16), with a working chamber (18) that is confined in areas by the piston (16), with an eccentric shaft (22) or camshaft that acts on the piston(16) at least indirectly on its end (36) furthest from the working chamber (18), and with a prestressing element (30) that loads the piston (16) at least indirectly against the eccentric shaft (22) or camshaft, wherein a support member (40) that is separate from the piston (16) is provided, which said support member is interconnected with the end region (36) of the piston (16) closest to the eccentric shaft (22) or camshaft, and against which the prestressing element (30) bears, wherein said fuel pump comprises a base part (28) that abuts the end surface of the piston (16) closest to the eccentric shaft (22) or camshaft, and wherein the base part (28) comprises an upwardly extending section (70) that covers the support member (40) axially in areas, and the support member (40) is securely interconnected with the base part (28) via the upwardly extending section (70).

10. A fuel pump (10) for an internal combustion engine, comprising: a housing (14), with at least one piston (16), with a working chamber (18) that is confined in areas by the piston (16), with an eccentric shaft (22) or camshaft that acts on the piston (16) at least indirectly on its end (36) furthest from the working chamber (18), and with a prestressing element (30) that loads the piston (16) at least indirectly against the eccentric shaft (22) or camshaft.

wherein a support member (40) that is separate from the piston (16) is provided, which said support member is interconnected with the end region (36) of the piston (16) closest to the eccentric shaft (22) or camshaft, and against which the prestressing element (30) bears, wherein said fuel pump comprises a base part (28) that abuts the end surface of the piston (16) closest to the eccentric shaft (22) or camshaft, and wherein the support member (40) comprises at least one bent-over section (48) that grips around the outside of the base part (28) and provides axial support for said base part and a support ring (52).

* * * * *